US012454427B2

(12) United States Patent
Nakamura et al.

(10) Patent No.: US 12,454,427 B2
(45) Date of Patent: Oct. 28, 2025

(54) SHEET CONVEYING DEVICE AND IMAGE FORMING APPARATUS INCORPORATING THE SHEET CONVEYING DEVICE

(71) Applicants: Kazune Nakamura, Tokyo (JP); Junichi Sugita, Tokyo (JP)

(72) Inventors: Kazune Nakamura, Tokyo (JP); Junichi Sugita, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 270 days.

(21) Appl. No.: 18/213,274

(22) Filed: Jun. 23, 2023

(65) Prior Publication Data

US 2023/0416029 A1 Dec. 28, 2023

(30) Foreign Application Priority Data

Jun. 23, 2022 (JP) ..... 2022-101005
Mar. 10, 2023 (JP) ..... 2023-038013

(51) Int. Cl.
*B65H 3/06* (2006.01)
*B65H 7/02* (2006.01)
*B65H 9/00* (2006.01)

(52) U.S. Cl.
CPC ..... *B65H 7/02* (2013.01); *B65H 3/0684* (2013.01); *B65H 9/002* (2013.01); *B65H 2404/1521* (2013.01); *B65H 2701/1311* (2013.01)

(58) Field of Classification Search
CPC ... B65H 1/08; B65H 1/14; B65H 7/02; B65H 3/06; B65H 3/0684; B65H 2404/1521
USPC ..... 271/109, 256, 258.01, 258.02, 258.05
See application file for complete search history.

(56) References Cited

U.S. PATENT DOCUMENTS 4,627,607 A * 12/1986 Ishii ..... B65H 3/5261 271/274
6,598,873 B2 * 7/2003 Takisawa ..... B65H 3/0669 271/254
8,118,299 B2 * 2/2012 Sato ..... G03G 15/6514 271/118
10,457,509 B2 * 10/2019 Kuriki ..... B65H 3/0676
11,242,213 B2 * 2/2022 Zaitsu ..... B65H 3/0684
2016/0334748 A1 11/2016 Aoyama et al.
2019/0283990 A1 9/2019 Zaitsu et al.
2020/0148492 A1 5/2020 Sugita
(Continued)

FOREIGN PATENT DOCUMENTS

JP 2016-124651 7/2016
JP 2021-066554 4/2021

*Primary Examiner* — Leslie A Nicholson, III
(74) *Attorney, Agent, or Firm* — XSENSUS LLP

(57) ABSTRACT

A sheet conveying device includes a pickup roller, a separator, a conveyor, and circuitry. The pickup roller contacts an uppermost sheet of sheets stacked on a sheet stacker and feed the uppermost sheet. The separator moves the pickup roller between a contact position at which the pickup roller is in contact with the uppermost sheet and a separation position at which the pickup roller is separated from the uppermost sheet. The conveyor conveys the uppermost sheet fed by the pickup roller. The circuitry is to control the conveyor to temporarily stop conveyance of the uppermost sheet, and control the separator to move the pickup roller from the contact position to the separation position in response to the temporarily stop of the conveyor.

13 Claims, 10 Drawing Sheets

(56) References Cited

U.S. PATENT DOCUMENTS

| | | | |
|---|---|---|---|
| 2020/0165086 | A1 | 5/2020 | Zaitsu et al. |
| 2020/0239248 | A1 | 7/2020 | Sugita |
| 2020/0371465 | A1 | 11/2020 | Nakamura et al. |
| 2021/0163244 | A1 | 6/2021 | Nakamura |
| 2022/0332455 | A1 | 10/2022 | Mizusawa et al. |

* cited by examiner

FIG. 7A
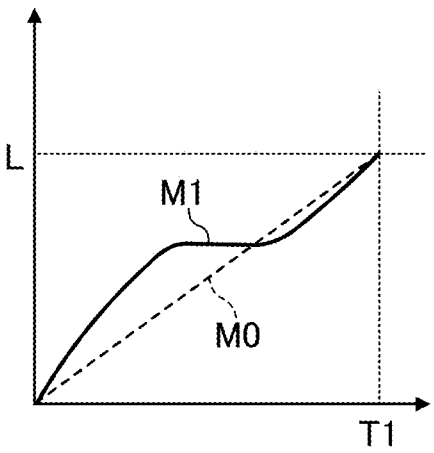
FIG. 7B
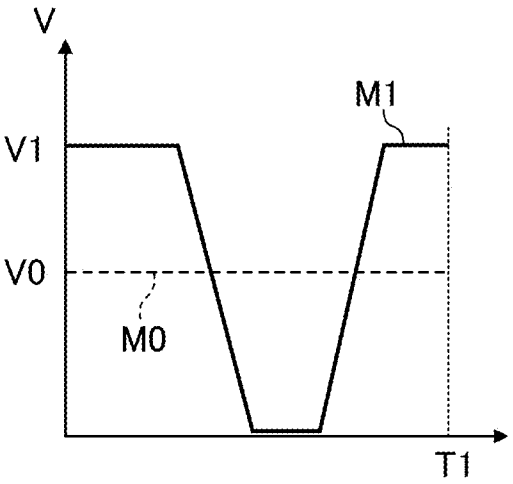
FIG. 8
| CATEGORIES / SETTING | LOW-SPEED MODE | MEDIUM-SPEED MODE | HIGH-SPEED MODE |
|---|---|---|---|
| SET SHEET CONVEYANCE SPEED (mm/s) | V | 2V | 4V |
| SHEET CONVEYANCE DISTANCE (mm) | L | | |
| SHEET ARRIVAL TIME AT REGISTRATION ROLLER PAIR (sec) | $\frac{L}{V}$ | $\frac{L}{2V}$ | $\frac{L}{4V}$ |

FIG. 9

| | LOW-SPEED MODE | MEDIUM-SPEED MODE | HIGH-SPEED MODE |
|---|---|---|---|
| SET SHEET CONVEYANCE SPEED (mm/s) | V | 2V | 4V |
| SHEET FEEDING SPEED (mm/s) | 2V | 4V | 4V |
| SHEET CONVEYANCE DISTANCE (mm) | L | | |
| SHEET CONVEYANCE TIME (sec) | $\frac{L}{V}$ | $\frac{L}{2V}$ | $\frac{L}{4V}$ |
| TEMPORARY STOP TIME (sec) | TH | TH | 0 |
| SHEET ARRIVAL TIME AT REGISTRATION ROLLER PAIR (sec) | $\frac{L}{2V} + TH$ | $\frac{L}{4V} + TH$ | $\frac{L}{4V}$ |

FIG. 10

| | HIGH-SPEED MODE | HIGH-SPEED LOW-NOISE MODE |
|---|---|---|
| SET SHEET CONVEYANCE SPEED (mm/s) | 4V | 4V |
| SHEET FEEDING SPEED (mm/s) | 4V | 4V |
| SHEET CONVEYANCE DISTANCE (mm) | L | |
| TEMPORARY STOP TIME (sec) | 0 | TH |
| SHEET ARRIVAL TIME AT REGISTRATION ROLLER PAIR (sec) | $\frac{L}{4V}$ | $\frac{L}{4V} + TH$ |

SHEET CONVEYING DEVICE AND IMAGE FORMING APPARATUS INCORPORATING THE SHEET CONVEYING DEVICE

CROSS-REFERENCE TO RELATED APPLICATIONS

This patent application is based on and claims priority pursuant to 35 U.S.C. § 119(a) to Japanese Patent Application Nos. 2022-101005, filed on Jun. 23, 2022, and 2023-038013, filed on Mar. 10, 2023, in the Japan Patent Office, the entire disclosure of each of which is hereby incorporated by reference herein.

BACKGROUND

Technical Field

Embodiments of the present disclosure relate to a sheet conveying device and an image forming apparatus incorporating the sheet conveying device.

Background Art

Various types of sheet conveying devices are known in the art that include a pickup roller that contacts an uppermost sheet of a sheet bundle stacked on a sheet stacker and feeds the uppermost sheet, a contact-separation mechanism that contacts or separates the pickup roller to or from the uppermost sheet, and a conveyance mechanism that conveys a sheet fed out by the pickup roller.

A sheet conveying device in the related art provides a technique that controls the speed of movement of a pickup roller from a contact position at which the pickup roller is in contact with the uppermost sheet to a separate position at which the pickup roller is separated from the uppermost sheet to be slower than the speed of movement of the pickup roller from the separate position to the contact position, and reduces the sound of collision that occurs when a pickup arm that rotatably supports the pickup roller contacts the stopper when the pickup roller is brought to the separate position.

SUMMARY

Embodiments of the present disclosure described herein provide a novel sheet conveying device including a sheet conveying device including a pickup roller, a separator, a conveyor, and circuitry. The pickup roller contacts an uppermost sheet of sheets stacked on a sheet stacker and feed the uppermost sheet. The separator moves the pickup roller between a contact position at which the pickup roller is in contact with the uppermost sheet and a separation position at which the pickup roller is separated from the uppermost sheet. The conveyor conveys the uppermost sheet fed by the pickup roller. The circuitry is to control the conveyor to temporarily stop conveyance of the uppermost sheet, and control the separator to move the pickup roller from the contact position to the separation position in response to the temporarily stop of the conveyor.

Further, embodiments of the present disclosure described herein provide an image forming apparatus including the above-described sheet conveying device to feed a sheet, and an image forming device to form an image on the sheet fed from the sheet conveying device.

Further, embodiments of the present disclosure described herein provide a sheet conveying device including a sheet conveying device including a pickup roller, a separator, a conveyor, and circuitry. The pickup roller contacts an uppermost sheet of sheets stacked on a sheet stacker and feed the uppermost sheet. The separator moves the pickup roller between a contact position at which the pickup roller is in contact with the uppermost sheet and a separation position at which the pickup roller is separated from the uppermost sheet. The conveyor conveys the uppermost sheet fed by the pickup roller. The circuitry is to control the separator to moves the pickup roller from the contact position to the separation position in a separation operation, control the conveyor to convey the uppermost sheet at a first conveyance speed from a start to a completion of the separating operation, and control the conveyor to convey the uppermost sheet at a second conveyance speed higher than the first conveyance speed after the completion of the separating operation.

Further, embodiments of the present disclosure described herein provide an image forming apparatus including the above-described sheet conveying device to feed a sheet, and an image forming device to form an image on the sheet fed from the sheet conveying device.

BRIEF DESCRIPTION OF THE SEVERAL VIEWS OF THE DRAWINGS

Exemplary embodiments of this disclosure will be described in detail based on the following figures, wherein:

FIG. 7A is a graph of the relation of a time from the start of feeding a sheet by the pickup roller and a conveyance distance of the conveyance sheet from the pickup roller;

FIG. 7B is a graph of the relation of a time from the start of feeding a sheet by the pickup roller and a sheet feeding speed of the conveyance sheet:

FIG. 8 is a table of a sheet conveyance speed set in each image formation mode and an allowable sheet arrival time to the registration roller pair from the start of the contact operation of the pickup roller in each image formation mode to the contact of the leading end of the sheet to the registration roller pair;

FIG. 9 is a table of specifications of each image formation mode;

FIG. 10 is a table of specifications of a high speed mode and specifications of a high-speed low-noise mode;

Figure 1:
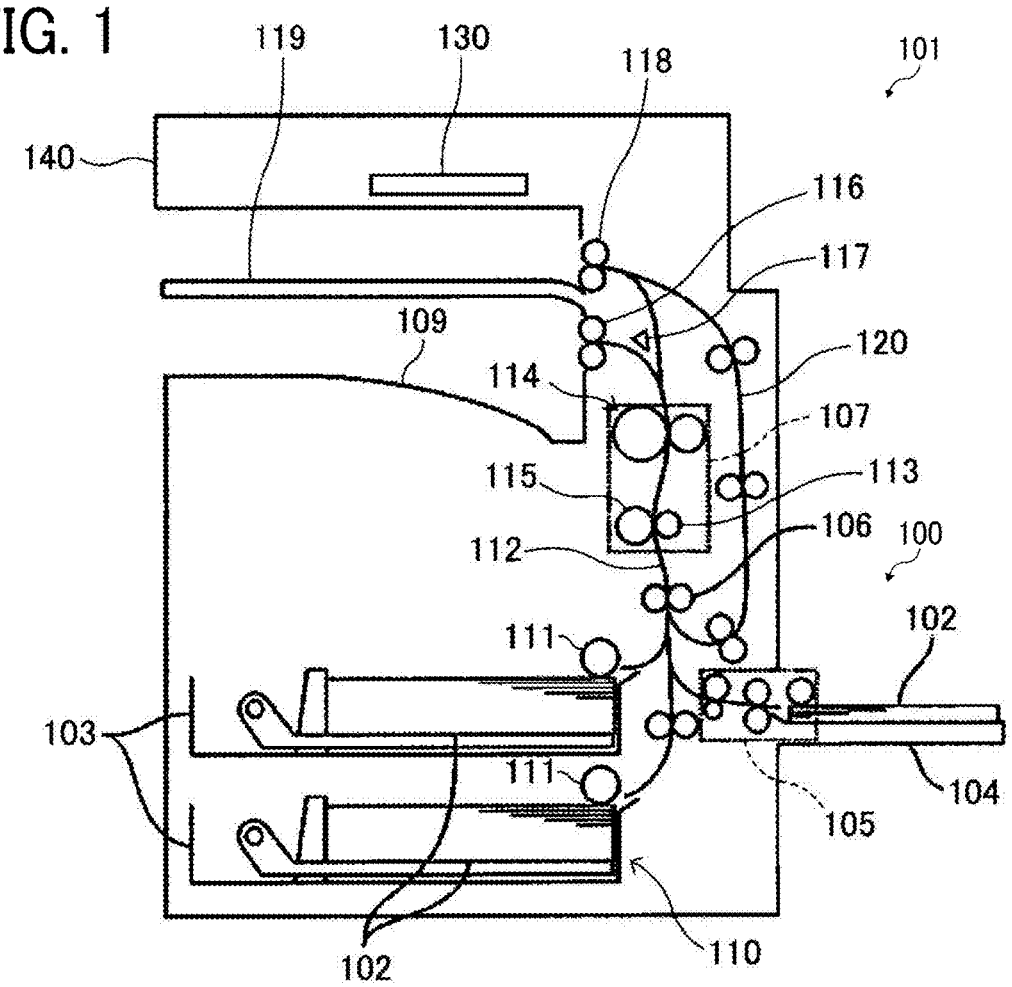
FIG. 1 is a diagram illustrating a schematic configuration of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. As used herein, the term "connected/coupled" includes both direct connections and connections in which there are one or more intermediate connecting elements. Like numbers refer to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

A description is given of an image forming apparatus according to an embodiment of the present disclosure.

FIG. 1 is a diagram illustrating a schematic configuration of an image forming apparatus according to an embodiment of the present disclosure.

As illustrated in FIG. 1, an image forming apparatus 101 includes an image forming device 107, a sheet feeding device 110 disposed at a position lower than the image forming device 107, and an image reading device 140 disposed at a position higher than the image forming device 107. The image forming apparatus 101 further includes an operation display unit 130 on which operations and displays for a user are displayed to perform image formation. The operation display unit 130 is mounted on the image forming apparatus 101.

The sheet feeding device 110 includes two sheet trays 103 each serving a sheet stacker detachably attached to the image forming apparatus 101. The sheet trays 103 (i.e., the upper sheet tray 103 and the lower sheet tray 103) are vertically disposed and accommodate different types of sheets 102 from each other. A sheet 102 of the sheets 102 stacked on each of the sheet trays 103 (i.e., the upper sheet tray 103 and the lower sheet tray 103) is fed by a sheet feed roller 111 from a selected one of the sheet trays 103 to a sheet conveyance passage 112 extending substantially vertically from the sheet feeding device 110 to a sheet ejection portion 109.

A bypass sheet tray 104 serving as a sheet stacker is disposed on the right side face of the image forming apparatus 101 in the drawing. The sheet 102 stacked on the bypass sheet tray 104 is fed by a bypass sheet feeding device 105 to the sheet conveyance passage 112.

The image forming device 107 includes a photoconductor 115 serving as an image bearer. A charging unit, a developing unit, a transfer roller 113, and a cleaning unit are disposed around the photoconductor 115. The charging unit uniformly charges the photoconductor 115. The developing unit develops an electrostatic latent image formed on the surface of the photoconductor 115 into a visible toner image by supplying toner onto the electrostatic latent image. The transfer roller 113 transfers the toner image formed by the developing unit onto the sheet 102 that is conveyed to the transfer roller 113. The cleaning unit cleans the photoconductor 115 by removing residual toner remaining on the surface of the photoconductor 115 after the transfer of the toner image.

The image forming device 107 further includes an optical writing device that forms an electrostatic latent image on the surface of the photoconductor 115. The optical writing device emits laser light to irradiate the surface of the photoconductor 115 based on image data of an original document read by the image reading device 140 or image data inputted via a personal computer (PC). By optically writing the image data by the optical writing device, an electrostatic latent image is formed on the surface of the photoconductor 115.

The image forming device 107 further includes a fixing unit 114 disposed downstream from the transfer roller 113 in the sheet conveyance direction. The fixing unit 114 fixes the toner image to the sheet 102 by the transfer roller 113 by application of heat and pressure to the toner image on the sheet 102.

The sheet 102 is fed selectively from any one of the two vertical sheet trays 103 and the bypass sheet tray 104, and is conveyed in the sheet conveyance passage 112. The sheet 102 conveyed to the sheet conveyance passage 112 is temporarily stopped by a registration roller pair 106 disposed upstream from the transfer roller 113 in the sheet conveyance direction, so that the posture of the sheet 102 is corrected. The sheet 102 is then conveyed at a given timing by the registration roller pair 106 to a transfer nip region formed between the transfer roller 113 and the photoconductor 115. The toner image on the photoconductor 115 is transferred onto the sheet 102 at the transfer nip region.

The sheet 102 having the toner image transferred in the transfer nip region is conveyed to the fixing unit 114, so that the toner image on the sheet 102 is fixed to the sheet 102 by application of heat and pressure in the fixing unit 114. After this fixing operation, the sheet 102 is conveyed by a sheet ejection roller pair 116 to be ejected to the sheet ejection portion 109 provided outside the image forming apparatus 101.

The image forming apparatus 101 according to the present embodiment can perform duplex printing as well as single-side printing. In duplex printing to print an image on both sides of a sheet 102, a toner image is fixed to the front of the sheet 102, then a branching claw 117 is switched to change the sheet conveyance passage to convey the sheet 102 toward a reverse roller pair 118.

The reverse roller pair 118 ejects the sheet 102 in the middle of the passage to a sheet reversal tray 119, reverses the sheet 102, and conveys the sheet 102 to a duplex sheet conveyance passage 120. After having been conveyed to the duplex sheet conveyance passage 120, it is determined whether the sheet 102 is on the front side or the back side. In the state where the front or back side of the sheet 102 is determined, the sheet 102 is conveyed to the position of the registration roller pair 106 again.

After the toner image has been transferred from the photoconductor 115 onto the back side of the sheet 102 that is conveyed from the registration roller pair 106 to the transfer nip region, the toner image is fixed to the sheet 102 in the fixing unit 114, then ejected to the sheet ejection portion 109 by the sheet ejection roller pair 116.

The image forming apparatus 101 according to the present embodiment has three kinds of image forming operation modes, which are a high-speed mode in which the image forming speed (i.e., the process speed) is high, a low-speed mode in which the image forming speed is low, and a medium-speed mode between the high-speed mode and the low-speed mode. The conveyance speed of the sheet 102 needs to be changed according to the image forming speed. The conveyance speed of the sheet 102 is set to a high speed in the high-speed mode, a low speed in the low-speed mode, or a medium speed in the medium-speed mode. When plain paper, thin paper, or recycled paper (collectively referred to as "plain paper") is fed, the high-speed mode or the medium-speed mode is selected. When thick paper is fed, the low-speed mode is selected. When the sheet to be fed is, for example, plain paper and the printing productivity is prioritized, the high-speed mode is selected. On the other hand, when the image quality is prioritized, the medium-speed mode is selected.

Figure 2:
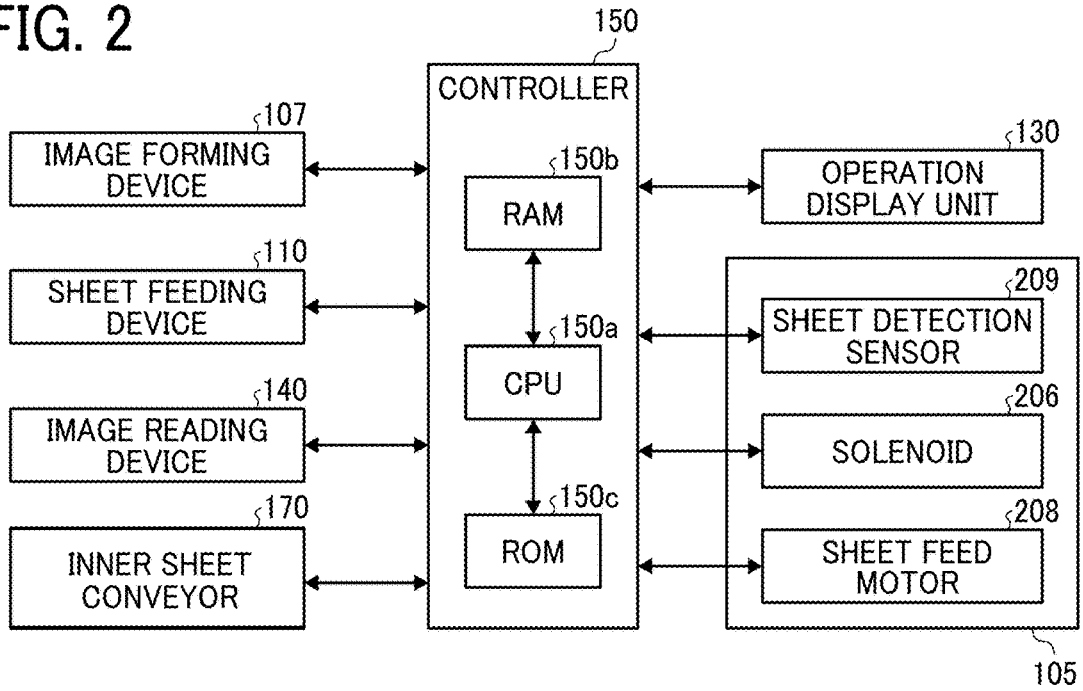
FIG. 2 is a block diagram illustrating a main part of the image forming apparatus of FIG. 1.

FIG. 2 is a block diagram illustrating a main part of the image forming apparatus 101.

The image forming apparatus 101 includes a controller 150 serving as a control unit to control the entire operations of the image forming apparatus 101. The controller 150 includes a central processing unit (CPU) 150*a* serving as an arithmetic unit, and an information memory unit. The information memory unit includes a random access memory (RAM) 150*b*, a read-only memory (ROM) 150*c*, and a hard disk drive (HDD). In the present embodiment, for example, a system operation system (OS), copier, facsimile machine, various control programs for the printer process, page description language (PDL) processing system of the image forming apparatus, the ROM 150*c* that stores initial setting values of the system, and the RAM 150*b* for working memory.

An inner sheet conveyor 170 serving as a conveyor includes multiple conveyance roller pairs, the sheet conveyance passage 112, and the duplex sheet conveyance passage 120. The multiple conveyance roller pairs include the registration roller pair 106, the sheet ejection roller pair 116, the reverse roller pair 118, and a conveyance roller pair 205 (see FIG. 4). The controller 150 controls the rotation speeds of the multiple conveyance roller pairs based on the set image formation mode (i.e., the low-speed mode, the medium-speed mode, or the high-speed mode), and conveys the sheet at a sheet conveyance speed in accordance with the process speed.

The controller 150 drives, for example, the photoconductor 115, the transfer roller 113, and the fixing unit 114 of the image forming device 107 at a given process speed, based on the set image formation mode (i.e., the low-speed mode, the medium-speed mode, or the high-speed mode).

Further, the controller 150 is electrically connected to a sheet detection sensor 209, a solenoid 206 (see FIG. 4), and a sheet feed motor 208 included in the bypass sheet feeding device 105 and controls the operations of the sheet detection sensor 209, the solenoid 206, and the sheet feed motor 208. The sheet detection sensor 209 is a sensor to detect presence or absence of the sheet 102 on the bypass sheet tray 104. The sheet feed motor 208 is a motor to drive and rotate, for example, a pickup roller 201, a feed roller 203, and a separation roller 204 included in the bypass sheet feeding device 105, which are described below.

FIGS. 3A to 3D are diagrams illustrating a series of sheet conveying operations from the bypass sheet tray 104 to the registration roller pair 106.

Figure 3A:
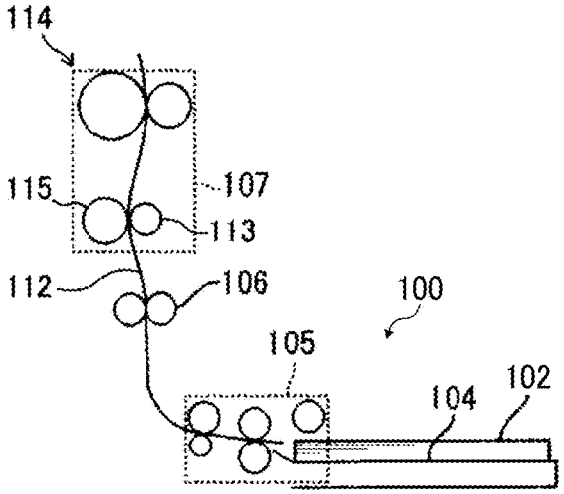
FIGS. 3A to 3D are diagrams illustrating a series of sheet feeding operations from a bypass tray to a registration roller pair.
Figure 3B:
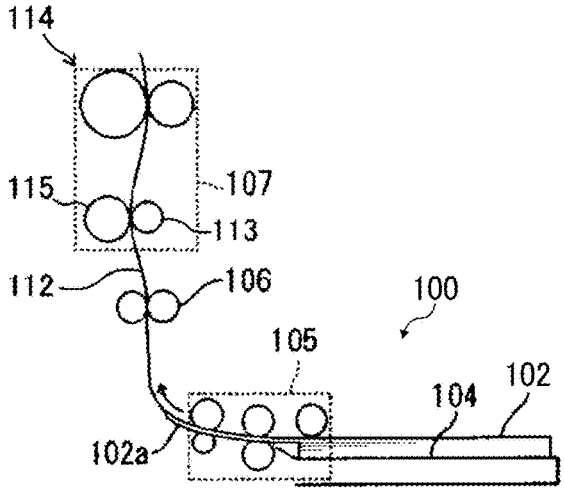

As illustrated in FIG. 3A, if an operator selects a sheet 102 on the bypass sheet tray 104 serving as a sheet stacker via, for example, the operation display unit 130 in a state where the sheets 102 are stacked on the bypass sheet tray 104, a sheet 102 is fed from the bypass sheet tray 104. Specifically, as illustrated in FIG. 3B, the sheets 102 of the sheet bundle stacked on the bypass sheet tray 104 are separated one by one by the bypass sheet feeding device 105, and the uppermost sheet of the sheet bundle is conveyed as a conveyance target sheet 102*a* to the downstream side of the sheet conveyance passage.

Figure 3C:
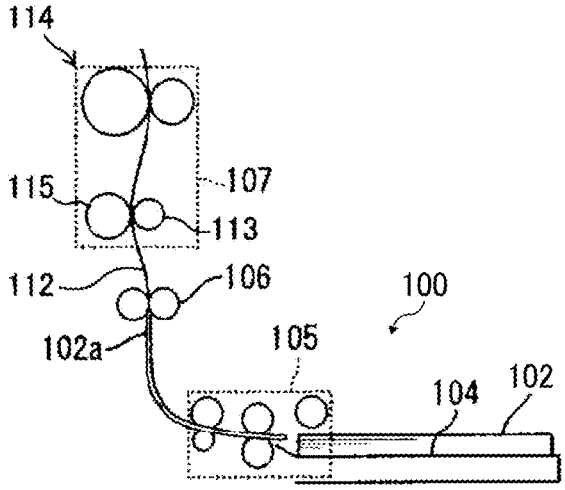

As illustrated in FIG. 3C, the conveyance target sheet 102*a* conveyed by the bypass sheet feeding device 105 is conveyed until the leading end of the conveyance target sheet 102*a* contacts the registration roller pair 106. At this time, the registration roller pair 106 is not rotated, and the position of the leading end of the conveyance target sheet 102*a* is aligned with respect to the sheet conveyance direction by pressing the conveyance target sheet 102*a* against the registration roller pair 106, thereby correcting the positional accuracy of printing. Thereafter, the conveyance target sheet 102*a* stands by at the position of the registration roller pair 106 until the system issues an instruction to restart conveyance of the conveyance target sheet 102*a* by the registration roller pair 106.

Figure 3D:
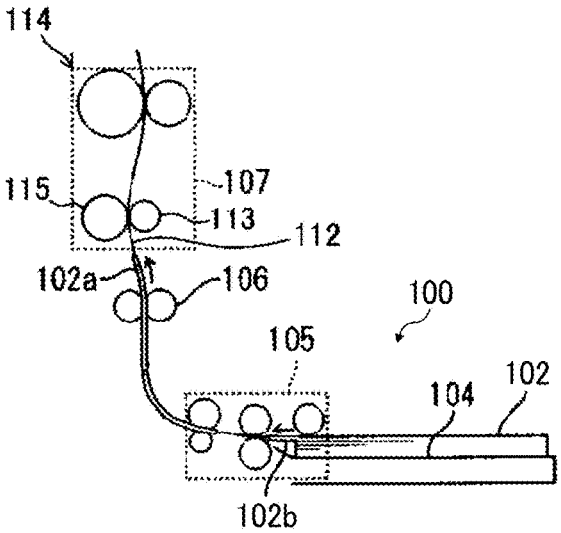

When the system issues the instruction to restart conveyance of the conveyance target sheet 102*a*, the conveyance target sheet 102*a* is conveyed again from the registration roller pair 106, as illustrated in FIG. 3D. Further, in the case of the continuous sheet feeding, the sheet feeding of a subsequent conveyance target sheet 102*b* is started at the timing of predetermined productivities (i.e., the high-speed mode, the medium-speed mode, and the low-speed mode) in accordance with the restart the conveyance of the subsequent conveyance target sheet 102*b* by the registration roller pair 106.

The above-described operation is a bypass sheet conveying operation per sheet. After the start of sheet feeding of the subsequent conveyance target sheet 102*b*, the operations illustrated in FIGS. 3B to 3D are repeated to continuously feed the sheets.

In order to function the positional accuracy correction of printing of this configuration, it is required that the conveyance target sheet 102*a* has completely been pressed against the registration roller pair 106 in the issuance of the instruction of the restart of conveying the preceding sheet and the subsequent sheet to the registration roller pair 106. As the printing time (i.e., the process speed) per sheet is defined from the setting of the printing productivity, the total of operation time periods of the sheet feeding operations is to be less than the printing time.

FIGS. 4A to 4D are diagrams illustrating a series of operations performed in the bypass sheet feeding device 105.

The bypass sheet feeding device 105 feeds a sheet using a feed and reverse roller (FRR) sheet feeding method. Specifically, the bypass sheet feeding device 105 includes a pickup roller 201, a feed roller 203, and a separation roller 204. The bypass sheet feeding device 105 further includes a contact-separation mechanism 210 that contacts or separates the pickup roller 201 to or from the uppermost sheet of the sheet bundle stacked on the bypass sheet tray 104. The contact-separation mechanism 210 includes a pickup arm 202, a solenoid 206, and a solenoid link 207.

The pickup roller 201 is rotatably supported by the pickup arm 202 of the contact-separation mechanism 210. The pickup arm 202 is rotatably attached to the rotary shaft of the feed roller 203. The pickup arm 202 is rotatable (swingable) around a feed roller shaft. This rotation of the pickup arm 202 causes the pickup roller 201 to contact or separate from the uppermost sheet of the sheet bundle.

The contact-separation mechanism 210 further includes a sheet feed pressure spring 213 serving as a biasing member attached to the pickup arm 202 at the portion opposite to the support portion of the pickup roller 201 across the rotational center of the pickup arm 202. The sheet feed pressure spring 213 biases the pickup roller 201 in the direction (i.e., the upward direction in the drawing) to which the pickup arm 202 is rotated to contact the surface of the uppermost sheet of the sheet bundle stacked on the bypass sheet tray 104. Applying the biasing force of the sheet feed pressure spring 213 for rotating the pickup arm 202 causes the pickup roller 201 to contact the surface of the uppermost sheet with a desired contact pressure (sheet feed pressure).

Figure 4A:
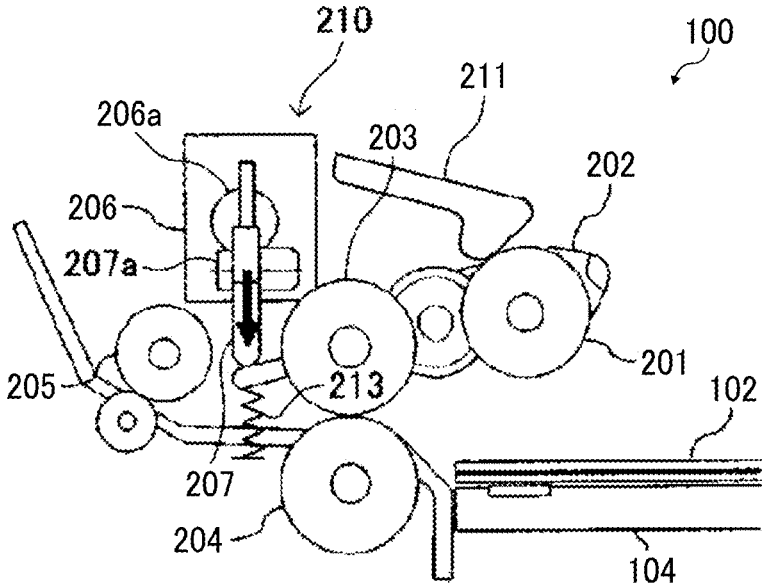
FIGS. 4A to 4D are diagrams illustrating a series of the sheet feeding operations performed in a bypass sheet feeding device.

The solenoid link 207 is rotatable around a rotary shaft 207*a*. The solenoid link 207 is biased by a spring in a direction perpendicular to the drawing sheet (i.e., the axial direction). When the solenoid 206 is off, the solenoid link 207 applies the biasing force of the spring to press down the pickup arm 202 at the portion opposite to the support portion of the pickup roller 201 across the rotational center of the pickup arm 202, against the biasing force of the sheet feed pressure spring 213 (see the arrow in FIG. 4A). As a result, as illustrated in FIG. 4A, the pickup roller 201 is at the separation position at which the pickup roller 201 is separated away from the upper surface of the uppermost sheet. When the pickup roller 201 is at the separated position, the pickup roller 201 is in contact with a cover 211 that hides the contact-separation mechanism 210. The cover 211 serves as a stopper to stop the pickup roller 201 at the separation position.

Further, the solenoid link 207 is coupled to a plunger 206*a* of the solenoid 206. When the solenoid 206 is turned on and sucks the plunger 206*a*, the solenoid link 207 rotates against the biasing force of the spring biasing the solenoid link 207 in the direction opposite to the direction of rotation of the solenoid link 207 by the spring. Thus, the contact portion of the solenoid link 207 with the pickup roller 201 is lifted up. Then, the pickup arm 202 is rotated in the clockwise direction in the drawing by the biasing force of the sheet feed pressure spring 213. As a result, the pickup roller 201 moves from the separation position at which the pickup roller 201 is separated from the uppermost sheet to the contact position illustrated in FIG. 4B where the pickup roller 201 contacts the upper surface of the uppermost sheet.

As described above, when the solenoid 206 is turned on and the pickup arm 202 is brought into contact with the upper surface of the uppermost sheet, a driving force is transmitted from the sheet feed motor 208 to the pickup roller 201 and the feed roller 203. In response to the above-described transmission, the pickup roller 201 and the feed roller 203 are driven to rotate in the direction indicated by the arrows in FIG. 4B. As a result, the uppermost sheet in contact with the pickup roller 201 is fed to the separation nip region formed between the feed roller 203 and separation roller 204 while being stacked on the bypass sheet tray 104.

The separation roller 204 transmits a driving force from the sheet feed motor 208 via a torque limiter. The separation roller 204 rotates in a direction opposite to the direction indicated by the arrow in FIG. 4B due to the driving force from the sheet feed motor 208. The torque limiter interrupts the drive transmission to the separation roller 204 when the torque applied to the separation roller 204 is equal to or greater than the specified value. On the other hand, when the torque applied to the separation roller 204 is smaller than the specified value, the driving force of the sheet feed motor 208 is transmitted to rotate the separation roller 204 in the direction opposite to the direction indicated by the arrow in FIG. 4B.

When a single conveyance target sheet 102*a* is nipped by the separation nip region formed between the feed roller 203 and the separation roller 204 (i.e., in the state illustrated in FIG. 4B) or when no conveyance target sheet 102*a* is nipped by the separation nip region, the rotational load applied to the separation roller 204 is relatively large. For this reason, at this time, the torque applied to the separation roller 204 is equal to or greater than the specified value, and the torque limiter interrupts the driving force from the sheet feed motor 208. Accordingly, the separation roller 204 idles relative to the torque limiter and is rotated together with the feed roller 203, in other words, is rotated in the direction indicated by the arrow in FIG. 4B.

On the other hand, when multiple sheets are nipped by the separation nip region, the rotational load applied to the separation roller 204 is relatively small due to slippage of the sheets. For this reason, at this time, the torque applied to the separation roller 204 is smaller than the specified value, and the torque limiter transmits the driving force from the sheet feed motor 208 to the separation roller 204. Accordingly, the separation roller 204 is rotated by the driving force from the motor in the direction opposite to the sheet conveyance direction indicated by the arrow in FIG. 4B. By so doing, of the multiple sheets nipped by the separation nip region, the lower sheets other than the uppermost sheet is returned to the bypass sheet tray 104.

The sheets that have passed through the separation nip region are conveyed by the conveyance roller pair 205 toward the registration roller pair 106. As the conveyance target sheet 102*a* is conveyed by a certain distance, the solenoid 206 is turned off and the suction state of the plunger 206*a* is cancelled. With this action, the solenoid link 207 is rotated by the biasing force of the spring to press down the pickup arm 202 at the portion opposite to the support portion of the pickup roller 201 across the rotational center of the pickup arm 202, against the biasing force of the sheet feed pressure spring 213. With this action, the pickup arm 202 is rotated in the counterclockwise direction in the drawing to move from the contact position to the separation position as illustrated in FIG. 4C. Accordingly, by separating the pickup roller 201 from the conveyance target sheet 102*a*, the subsequent sheet is prevented from being fed after the trailing end of the conveyance target sheet 102*a* has passed through the pickup roller 201.

Figure 4B:
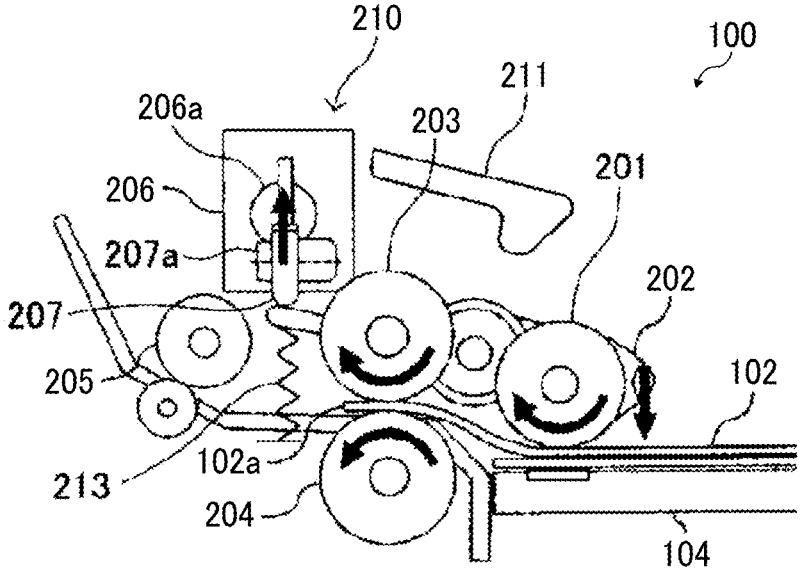
Figure 4C:
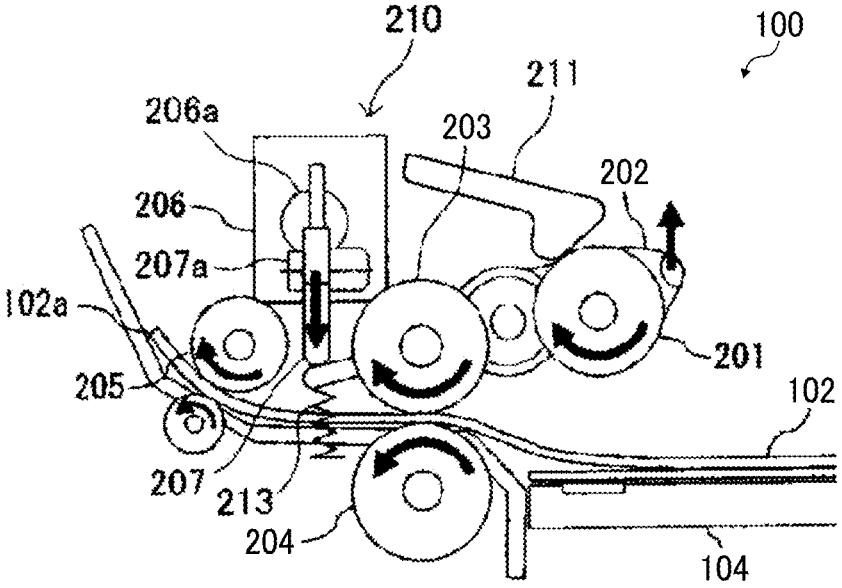
Figure 4D:
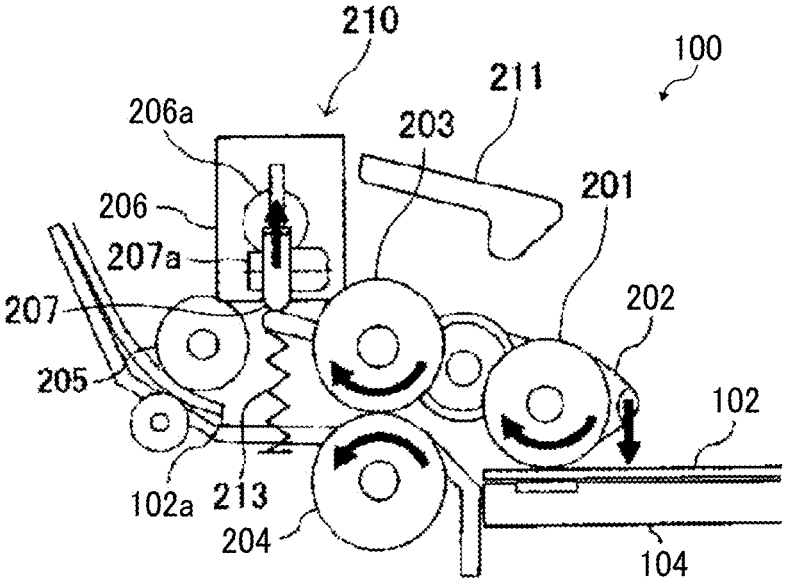

In the case of the continuous printing, as illustrated in FIG. 4D, the same operation as the operation illustrated in FIG. 4B is started at the timing of instruction to start feeding the subsequent sheet (i.e., the same timing as the timing of instruction to restart the registration conveyance in the present embodiment), so that the pickup roller 201 is brought to contact with the upper face of the uppermost sheet again to feed the sheet.

In FIG. 4C, the contact of the pickup roller 201 with the conveyance target sheet 102*a* needs to be cancelled before the trailing end of the conveyance target sheet 102*a* passes through the pickup roller 201. If the trailing end of the conveyance target sheet 102*a* passes through the pickup roller 201 while the pickup roller 201 is in contact with the conveyance target sheet 102*a*, the subsequent sheet is fed by the pickup roller 201. When the length of the sheet is short in the sheet conveyance direction, the time is short from when the leading end of the sheet passes through the conveyance roller pair 205 and the sheet is conveyed by the conveyance roller pair 205 to when the trailing end of the sheet passes through the pickup roller 201. Know sheet conveying devices move the pickup roller 201 from the contact position to the separation position at high speed so that the pickup roller 201 can move from the contact position to the separation position in this short time. However, in this case, when the pickup roller 201 is moved to the separation position, the pickup roller 201 contacts the cover 211 at the high speed to generate a sound of collision.

In order to reduce the sound of collision, it is conceivable that the moving time of the solenoid is controlled to be longer and the moving speed ("separating speed") of the pickup roller from the contact position to the separation position is controlled to be slower.

Figure 5:
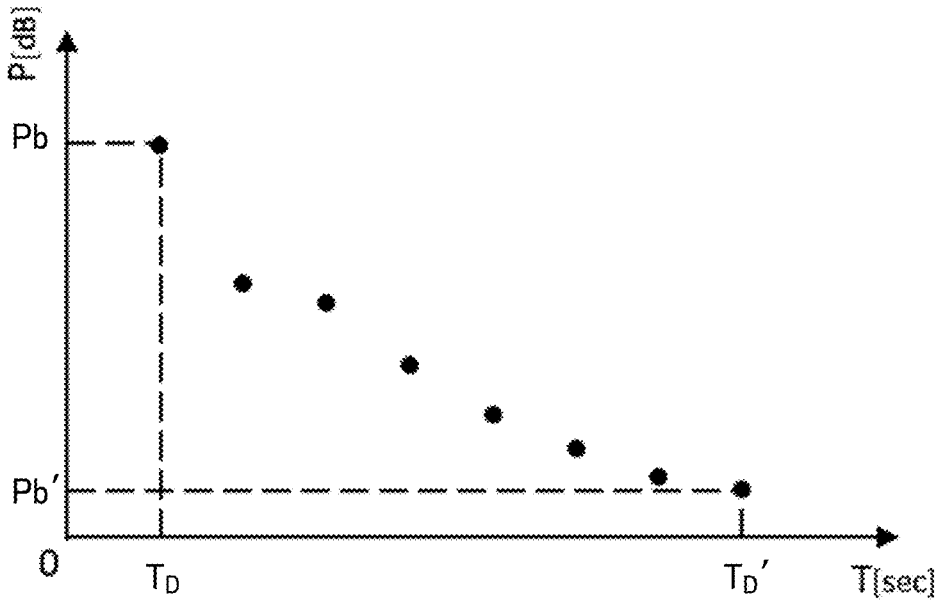
FIG. 5 is a diagram illustrating a relation of the sound of collision occurred when a pickup roller is moved to a separation position and a separating operation time.

FIG. 5 is a diagram illustrating a relation of the sound of collision P [db] occurred when the pickup roller 201 is moved to the separation position and a separating operation time T [sec] that is a time that the pickup roller 201 is moved from the contact position to the separation position.

As illustrated in FIG. 5, as the separating speed of the pickup roller 201 is decreased to make the separating operation time longer, the sound of collision P occurred when the pickup roller 201 contacts the cover 211 can be more reduced.

However, if the separating speed of the pickup roller 201 is slow, the sheet having the length in the sheet conveyance direction is short, the trailing end of the conveyance target sheet 102*a* is likely to pass through the pickup roller 201 before the contact of the pickup roller 201 with the conveyance target sheet 102*a* is cancelled. The pickup roller 201 is in contact with the uppermost sheet with the predetermined pressure by the biasing force of the sheet feed pressure spring 213. At this time, the rubber layer of the pickup roller 201 is compressed and deformed to contact with the uppermost sheet. Due to this configuration, after the pickup roller 201 starts to move from the contact position to the separation position and the rubber layer of the pickup roller 201 is restored to the original shape, the pickup roller 201 separates from the uppermost sheet. For this reason, the pickup roller 201 remains in contact with the conveyance target sheet 102*a* for a while after the pickup roller 201 starts to move to the separation position. If the separating speed of the pickup roller 201 is slow, the time from the start of movement of the pickup roller 201 to the cancellation of the contact of the pickup roller 201 with the conveyance target sheet 102*a* becomes longer. For this reason, if the length of the sheet is short in the sheet conveyance direction, the trailing end of the conveyance target sheet 102*a* is likely to pass through the pickup roller 201 before the contact of the pickup roller 201 with the conveyance target sheet 102*a* is cancelled. If the trailing end of the conveyance target sheet 102*a* passes through the pickup roller 201 before the contact of the pickup roller 201 with the conveyance target sheet 102*a* is cancelled as described above, the subsequent sheet is fed by the pickup roller 201 at a timing other than the target timing.

If the distance of movement of the pickup roller 201 from the contact position to the separation position is relatively long, the separating speed is set to a high speed and the separating speed is decreased after the cancellation of the contact of the pickup roller 201 from the start of the separating operation until the contact of the pickup roller 201 with the conveyance sheet is cancelled, a reduction in the sound of collision can be attempted. However, if the distance of movement of the pickup roller 201 is relatively short from the contact position to the separation position, the separating speed cannot be reduced sufficiently after the cancellation of the contact of the pickup roller 201, and the sound of collision with the cover 211 cannot be reduced sufficiently.

In order to address this inconvenience, in the present embodiment, the conveyance of the sheet is temporarily stopped and the separating operation of the pickup roller 201 is performed. Accordingly, if the separating speed of the pickup roller 201 is made slow, the trailing end of the conveyance target sheet 102*a* does not pass through the pickup roller 201 before the contact of the pickup roller 201 with the conveyance target sheet 102*a* is cancelled. A detailed description is now given of the sheet conveying device 100 according to the present embodiment, with reference to the drawings.

Figure 6A:
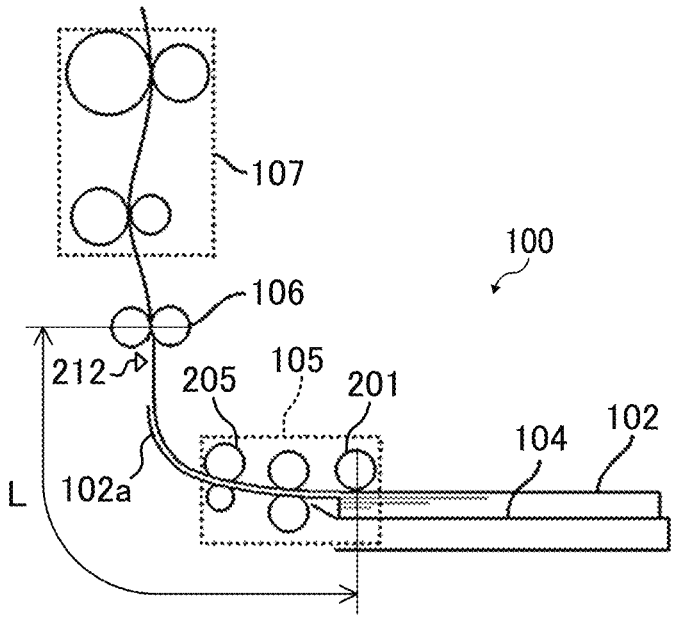
FIGS. 6A and 6B are diagrams illustrating conveyance control according to the present embodiment.
Figure 6B:
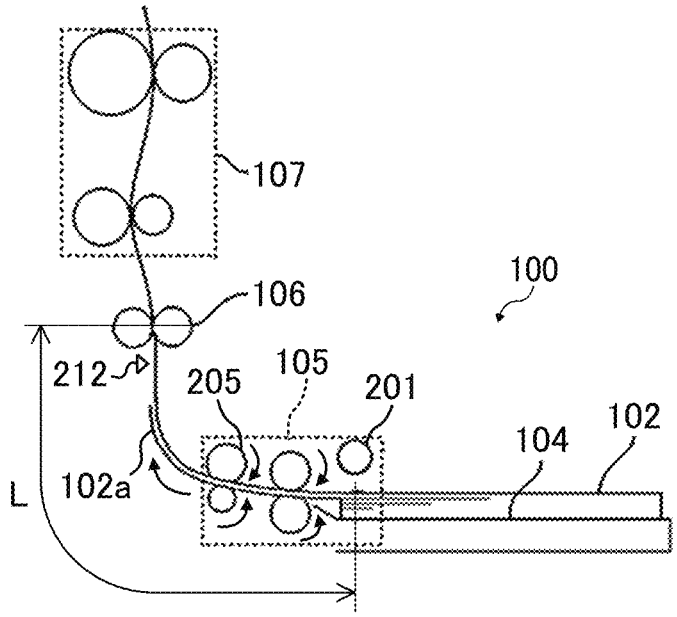

FIGS. 6A and 6B are diagrams illustrating conveyance control according to the present embodiment.

As illustrated in FIG. 6A, the controller 150 (see FIG. 2) temporarily stops the conveyance of the conveyance target sheet 102*a* at the predetermined timing from when the leading end of the conveyance target sheet 102*a* passes through the conveyance roller pair 205 to when the leading end of the conveyance target sheet 102*a* is detected by a conveyance sensor 212. Specifically, the controller 150 controls the inner sheet conveyor 170 to stop the rotation and driving of the conveyance roller pair 205 and the sheet feed motor 208, and stop the rotations of the pickup roller 201, the feed roller 203, and the separation roller 204.

A sensor may be disposed proximate to the downstream side of the conveyance roller pair 205 in the sheet conveyance direction, so that the sensor detects that the leading end of the conveyance target sheet 102*a* has passed through the conveyance roller pair 205. After the conveyance target sheet 102*a* has been conveyed for a predetermined time from the detection of the leading end of the conveyance target sheet 102*a* with the sensor, the conveyance of the conveyance target sheet 102*a* may be temporarily stopped.

At the same time as the conveyance of the conveyance target sheet 102*a* is temporarily stopped, the controller 150 controls the solenoid 206 to move the pickup roller 201 from the contact position to the separation position. When the pickup roller 201 is moved to the separation position, the rotation and driving of the conveyance roller pair 205 and the driving of the sheet feed motor 208 are resumed, as illustrated in FIG. 6B. As a result, the pickup roller 201, the feed roller 203, and the separation roller 204 resume the rotations, and the conveyance of the conveyance target sheet 102*a* is resumed.

In the above description, the sheet conveyance is resumed when the pickup roller 201 is moved to the separated position. However, the sheet conveyance may be resumed at a timing when the contact of the pickup roller 201 with the conveyance target sheet 102*a* is cancelled. Further, a sensor may be disposed proximate to the cover 211 (see FIG. 4C) to which the pickup roller 201 contacts at the separation position, so that the sensor detects that the pickup roller 201 is located at the separation position. After the pickup roller 201 is detected with the sensor, the conveyance of the sheet may be resumed.

As a result, even if the separating speed of the pickup roller 201 is made slow, the trailing end of the conveyance target sheet 102*a* does not pass through the pickup roller 201 before the contact of the pickup roller 201 with the conveyance target sheet 102*a* is cancelled. Accordingly, the sound of collision occurred in the movement of the pickup roller 201 from the contact position to the separation position can be reduced and the subsequent sheet can be prevented from being fed by the pickup roller 201 at a timing other than the target timing.

However, when the conveyance of the sheet is temporarily stopped, the arrival of the sheet at the registration roller pair 106 is delayed as compared with the typical conveyance of a sheet. In the present embodiment, image formation is started at the timing that the sheet reaches the registration roller pair 106 (i.e., the timing when the conveyance sensor 212 detects the sheet). Due to this action, the length of time from the start of conveyance of the sheet by the pickup roller 201 to the arrival of the leading end of the sheet at the registration roller pair 106 ("sheet arrival time at registration roller pair" or simply "sheet arrival time") directly affects the printing productivity. As a result, the conveyance of the sheet is temporarily stopped, and the sheet arrival time at the registration roller pair 106 becomes longer, resulting in a reduction in the productivity. In order to address this inconvenience, in the present embodiment, the sheet conveyance speed to the registration roller pair 106 ("sheet feeding speed") is increased so that the sheet arrival time at the registration roller pair 106 does not become long.

FIG. 7A is a graph of the relation of a time from the start of feeding a sheet by the pickup roller 201 and a conveyance distance of the conveyance target sheet 102*a* from the pickup roller 201.

FIG. 7B is a graph of the relation of a time from the start of feeding a sheet by the pickup roller 201 and a sheet feeding speed of the conveyance target sheet 102*a*.

In FIGS. 7A and 7B, reference sign "M0" indicates the movement of a sheet in a known technique, reference sign "M1" indicates the movement of a sheet of the present embodiment, and reference sign "L" indicates the sheet conveyance distance from the pickup roller 201 to the registration roller pair 106.

In the movement M0, the conveyance target sheet 102*a* is conveyed at the sheet feeding speed V0 without being temporarily stopped, so that the leading end of the conveyance target sheet 102*a* contacts the registration roller pair 106 at the target sheet arrival time T1 at the registration roller pair 106. In the present embodiment, the conveyance of the sheet is temporarily stopped for a predetermined time in the middle of the conveyance, so that the pickup roller 201 can be separated from the sheet at low speed. However, by making the sheet feeding speed V1 to be higher than the typical sheet feeding speed V0 (V1>V0), the conveyance target sheet 102*a* of the present embodiment can be conveyed to the registration roller pair 106 at the target sheet arrival time T1. Accordingly, the sound of collision occurred in the separating operation of the pickup roller 201 can be reduced and the subsequent sheet can be prevented from being fed by the pickup roller 201 at a timing other than the target timing, without reducing the productivity.

In the present embodiment, a low-speed mode, a medium-speed mode, and a high-speed mode are provided. The low-speed mode is a mode that is automatically set when a sheet set on the bypass sheet tray 104 or the upper or lower sheet trays 103 is a thick sheet. On the other hand, the medium-speed mode is a mode that is set, for example, for obtaining a high-quality image. The high-speed mode is a mode that is set for a standard image quality to increase the productivity. The medium-speed mode and the high-speed mode can be set by a user by operating the operation display unit 130.

FIG. 8 is a table of a sheet conveyance speed set in each image formation mode and the sheet arrival time at the registration roller pair 106 from the start of the contact action of the pickup roller 201 to the contact of the leading end of the sheet to the registration roller pair in each image formation mode.

The table of FIG. 8 presents, as approximate speed ratios, the sheet conveyance speed in the medium-speed mode is set to be twice the sheet conveyance speed of the low-speed mode, and the sheet conveyance speed in the high-speed mode is set to be four times the sheet conveyance speed of the low-speed mode. The speed ratio of each mode may be determined as appropriate.

As illustrated in FIG. 8, the sheet arrival time at the registration roller pair 106 in the low-speed mode is (L/V). If the leading end of the conveyance sheet does not arrive at the registration roller pair 106 within this time, the productivity of the image forming apparatus 101 according to the present embodiment becomes lower than the productivity of the typical apparatus.

The sheet arrival time at the registration roller pair in the medium-speed mode is (L/2V), and the sheet arrival time is reduced by half compared to the sheet arrival time in the low speed mode (L/V). The sheet arrival time in the high-speed mode is (L/4V), which is four times shorter than the sheet arrival time in the low-speed mode.

FIG. 9 is a table of specifications of each image formation mode.

FIG. 9 illustrates an example of specifications of each mode in a case where the temporary stop time TH in the separating operation of the pickup roller 201 is (L/2V).

The temporary stop time TH is a time from when the conveyance roller pair 205 and the sheet feed motor 208 are stopped driving to when the driving is restarted. In the present embodiment, the separating operation of the pickup roller 201 is started at the same timing as the timing at which the conveyance roller pair 205 and the sheet feed motor 208 are stopped driving. Then, when the pickup roller 201 is located at the separation position, the driving is resumed.

Due to such a configuration, the temporary stop time TH is the same as the separating operation time of the pickup roller 201.

When the temporary stop time TH is (L/2V), the sheet feeding speed in the low-speed mode may be set to 2V and the sheet feeding speed in the medium-speed mode may be set to 4V, as illustrated in FIG. 9.

To be more specific, when the sheet feeding speed in the low-speed mode is set to 2V, the relation of (L/V)=(L/2V)+TH is established. As described above, as the temporary stop time TH is (L/2V), the above-described relation can be satisfied by setting the sheet feeding speed to 2V. As a result, by setting the sheet feeding speed in the low-speed mode to 2V, the pickup roller 201 can be separated from the sheet at a low speed without reducing the productivity.

When the sheet feeding speed in the medium-speed mode is set to 4V, the relation of (L/2V)=(L/4V)+TH is obtained. As the temporary stop time TH is (L/2V), the above relational expression can be satisfied by setting the sheet feeding speed to 4V. As a result, the pickup roller 201 can be separated from the sheet at low speed without reducing the productivity.

As described above, the sheet feeding speed is set to 2V in the low-speed mode and the sheet feeding speed is set to 4V in the medium-speed mode, where 4V is the maximum sheet feeding speed of this apparatus. By so doing, the conveyance of the sheet is controlled to temporarily stop and the pickup roller 201 is separated in the low-speed mode, without reducing the productivity.

Further, the sheet feeding speed in the low-speed mode may be set to 4V to obtain a temporary stop time longer than the sheet feeding speed in the medium-speed mode, so that the separating speed of the pickup roller 201 can be slower than the sheet feeding speed in the medium-speed mode. This setting can further reduce the sound of collision in the separating operation of the pickup roller 201 in the low-speed mode.

Further, the temporary stop control may not be performed in the low-speed mode, so that the pickup roller 201 can be separated from the sheet at low speed. The sheet conveyance speed in the low-speed mode is half the sheet conveyance speed in the medium-speed mode and the sheet conveyance distance for the predetermined time is half the sheet conveyance distance in the medium-speed mode. Due to such a configuration, depending on the apparatus configuration, even when the sheet has the minimum size in the sheet conveyance direction that can be conveyed in the apparatus, the trailing end of the sheet can pass through the pickup roller after the contact of the pickup roller with the sheet is released without temporarily stopping the sheet conveyance in the low-speed mode. For this reason, in the low-speed mode, the separating operation of the pickup roller may be performed at low speed without executing the temporary stop of the conveyance of the sheet. Accordingly, in the low-speed mode, the sheet to be conveyed at the set sheet conveyance speed in which the sheet conveyance speed is set to convey the sheet to the registration roller pair.

On the other hand, the set sheet conveyance speed in the high-speed mode is set to 4V that is the maximum sheet conveyance speed of this apparatus. Due to this configuration, the sheet feeding speed cannot be faster than the set sheet conveyance speed. Accordingly, if the conveyance of a sheet is temporarily stopped in the high-speed mode, the productivity is reduced. Due to such a configuration, in the high-speed mode, the sheet conveyance is not temporarily stopped (in FIG. 9, the temporary stop time is "0") as in the typical image forming apparatus, and the pickup roller 201 is separated at the same separation speed as the typical image forming apparatus.

In the high-speed mode, by separating the pickup roller 201 at the same speed as the speed in the typical image forming apparatus without reducing the separation speed, the sound of collision with the cover 211 increases. Some users may feel the sound of collision uncomfortable. For this reason, the image forming apparatus may have the high-speed mode serving as a second mode that is similar to a mode in a typical image forming apparatus and the high-speed low-noise mode serving as a first mode that focuses on the low noise (quietness) even though the productivity is more reduced than the high-speed mode. In the high-speed low-noise mode, the sheet conveyance is temporarily stopped to perform the separating operation of the pickup roller, and the separating speed of the pickup roller 201 is made lower than that in the high-speed mode to reduce the sound of collision.

FIG. 10 is a table illustrating examples of specifications in the high-speed mode and specifications in the high-speed low-noise mode.

As illustrated in FIG. 10, similar to the high-speed mode, the sheet feeding speed in the high-speed low-noise mode to the registration roller pair 106 is set to 4V, which is the same speed as the set sheet conveyance speed. In the high-speed low-noise mode, the temporary stop control is performed. By temporarily stopping the conveyance of a sheet, the separating speed of the pickup roller is reduced to perform the separating operation. As a result, the sound of collision can be reduced and to the subsequent sheet can be prevented from being fed at a timing other than the target timing when the sheet is shorter in the sheet conveyance direction.

However, as illustrated in FIG. 10, the conveyance of a sheet is temporarily stopped in the separating operation in the high-speed low-noise mode. For this reason, the arrival timing at which the leading end of the sheet reaches the registration roller pair 106 is delayed by the time TH from the arrival timing in the high-speed mode. As a result, the productivity in the high-speed low-noise mode is lower than the productivity in the high-speed mode. As described above, the configuration of the image forming apparatus 101 according to the present embodiment has the high-speed mode focusing on the productivity and the high-speed and low-noise mode focusing on the low noise or quietness. Due to such a configuration, users focusing on the low noise (quietness) may select the high-speed and low-noise mode, and users focusing on the productivity rather than the low noise may select the high-speed mode. Accordingly, this configuration can satisfy the users pursuing the low noise (quietness) and users pursuing the productivity.

Figure 11:
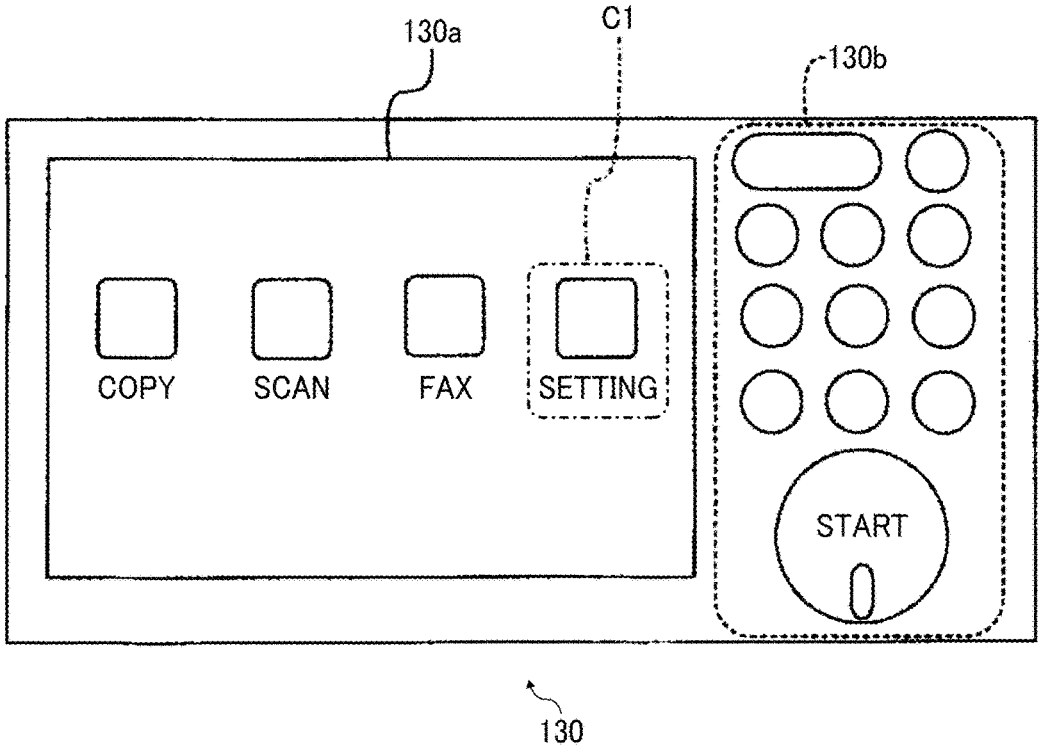
FIG. 11 is a diagram illustrating a state where an initial screen is displayed on a display portion of an operation display unit.

FIG. 11 is a diagram illustrating the operation display unit 130 in the state where an initial screen (home screen) is displayed on a display portion 130*a* of the operation display unit 130.

As illustrated in FIG. 11, the operation display unit 130 includes the display portion 130*a* formed of, for example, a liquid crystal display (LCD) and an operation portion 130*b* having a numeric keypad and a start button. The display portion 130*a* has a function of a touch panel and can detect a user's contact position as well as various kinds of displays. Further, the operation portion 130*b* may be a graphical user interface (GUI) component displayed on a touch panel.

Figure 12:
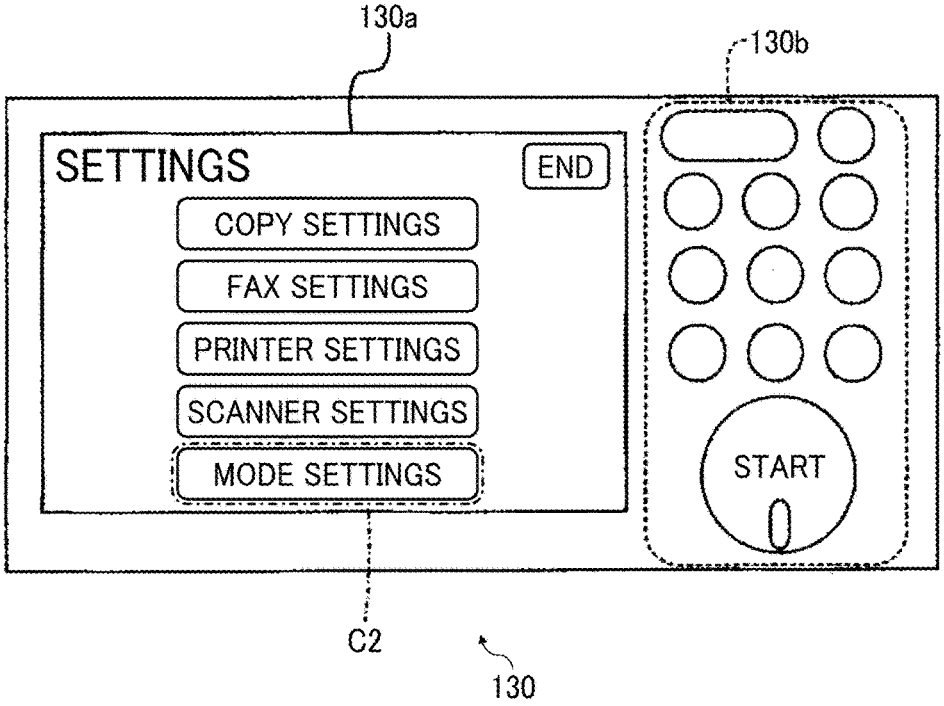
FIG. 12 is a diagram illustrating a state where a setting screen is displayed on the display portion of the operation display unit.
Figure 13:
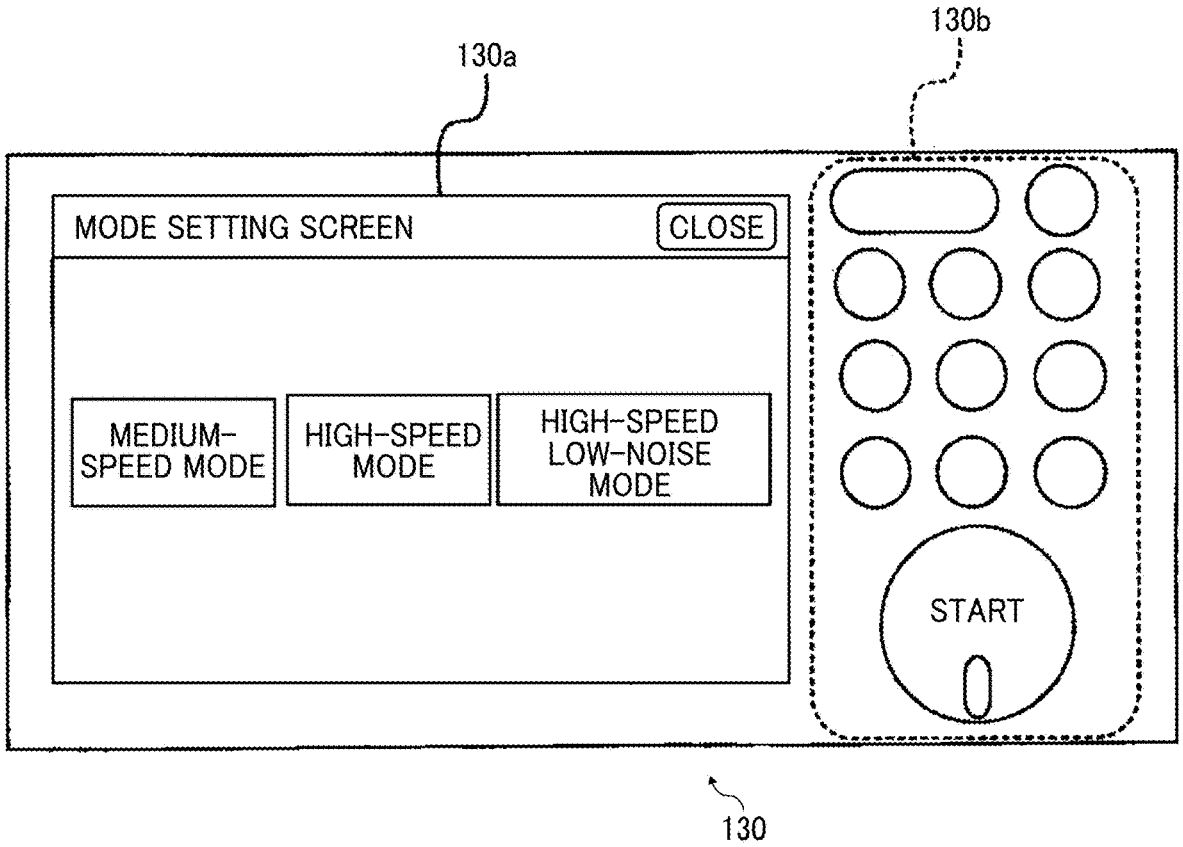
FIG. 13 is a diagram illustrating a state where a mode setting screen is displayed on the display portion of the operation display unit.

When setting the mode, the user first presses the GUI component C1 indicating "SETTING" displayed on the display portion 130*a*. Then, as illustrated in FIG. 12, the screen displayed on the display portion 130*a* is switched from the initial screen to the setting screen. Then, when the user presses the GUI component C2 indicating "MODE SETTINGS" displayed on the display portion 130*a*, the screen of the display portion 130*a* is switched to a mode setting screen as illustrated in FIG. 13. When a user presses any one of the GUI components indicating "MEDIUM-SPEED MODE", "HIGH-SPEED MODE", and "HIGH-SPEED LOW-NOISE MODE" displayed on the display portion 130*a*, the selected one of the medium-speed mode, the high-speed mode, and the high-speed low-noise mode is set. As described above, the low-speed mode is a mode that is automatically set when the set sheet is a thick paper. For this reason, the GUI component indicating "LOW-SPEED MODE" is not displayed on the mode setting screen.

The titles of the GUI components corresponding to the respective modes in FIG. 13 are not limited to those described above, and may be determined as appropriate. For example, the title of the GUI component corresponding to "HIGH-SPEED MODE" may be represented as "STANDARD MODE", the title of the GUI component corresponding to "MEDIUM-SPEED MODE" may be represented as "HIGH QUALITY MODE", and the title of the GUI component corresponding to "HIGH-SPEED LOW-NOISE MODE" may be represented as "LOW-NOISE MODE". Depending on the apparatus configuration, the "LOW-SPEED MODE" may be presented as a "HIGH IMAGE QUALITY MODE", the "MEDIUM-SPEED MODE" may be represented as a "STANDARD MODE", the "HIGH-SPEED MODE" may be represented as a "PRODUCTIVITY-FIRST MODE", and the "HIGH-SPEED LOW-NOISE MODE" may be represented as a "PRODUCTIVITY AND LOW-NOISE MODE".

Alternatively, whether or not to perform the temporary stop may be determined in accordance with the length of the conveyance target sheet 102*a* in the sheet conveyance direction. As described above, if the separating speed of the pickup roller 201 is slow with the sheet having the length short in the sheet conveyance direction, the trailing end of the conveyance target sheet 102*a* is likely to pass through the pickup roller 201 before the pickup roller 201 is separated from the conveyance target sheet 102*a*. Due to such a configuration, when the sheet has the length in the sheet conveyance direction is sufficiently long, even if the separating speed of the pickup roller 201 is slow, the trailing end of the conveyance target sheet 102*a* does not pass through the pickup roller 201 before the contact of the pickup roller 201 with the conveyance target sheet 102*a* is cancelled. For this reason, for example, a detector is provided to detect whether or not the length of the sheet set on the bypass sheet tray is equal to or longer than a predetermined length. When the length of the set sheet is shorter than the predetermined length, the conveyance of the sheet may be temporarily stopped to perform the separating operation. When the length of the set sheet is equal to or longer than the predetermined length, the separating operation may be performed without temporarily stopping the conveyance of the sheet.

In the above description, the separating operation of the pickup roller 201 is performed by temporarily stopping the conveyance of the sheet. However, the sheet conveying speed from the start to the completion of the separating operation of the pickup roller 201 may be set lower than the sheet conveyance speed after the completion of the separating operation. By reducing the sheet conveyance speed in this manner, the amount of the sheet conveyance amount from the start to the completion of the separating operation of the pickup roller 201. Due to such a configuration, even if the separating speed of the pickup roller 201 is made slow, the trailing end of the conveyance target sheet 102*a* does not to pass through the pickup roller 201 before the contact of the pickup roller 201 with the conveyance target sheet 102*a* is cancelled. In the above description, the sheet conveying speed is decreased until the completion of the separating operation of the pickup roller 201 to be easily controlled. However, the sheet conveying speed may be decreased until the contact of the pickup roller with the sheet is cancelled. Moreover, the sheet conveying speed in the separating operation of the pickup roller 201 may be determined in accordance with the length in the sheet conveyance direction of the sheet to be conveyed, so that the trailing end of the sheet does not pass through the pickup roller until the contact of the pickup roller with the sheet is cancelled.

The bypass sheet tray 104 is applied to the present embodiment. However, the present disclosure is also applied to the conveyance of sheets on either of the sheet trays 103.

Although specific embodiments are described, the embodiments according to the present disclosure are not limited to those specifically described herein.

Several aspects of the drive device and the image forming apparatus are exemplified as follows.

Aspect 1

In Aspect 1, a sheet conveying device (for example, the sheet conveying device 100) includes a pickup roller (for example, a pickup roller 201), a separator (for example, the contact-separation mechanism 210), a conveyor (for example, the inner sheet conveyor 170), and circuitry (for example, the controller 150). The pickup roller contacts an uppermost sheet of sheets stacked on a sheet stacker (for example, the sheet tray 103, the bypass sheet tray 104) and feeds the uppermost sheet. The separator brings the pickup roller to contact or separate from the uppermost sheet. The conveyor conveys the uppermost sheet fed by the pickup roller. The circuitry controls operations performed in the sheet conveying device. The circuitry temporarily stops conveyance of the uppermost sheet by the conveyor during a period of time from a start of a separation movement in which the pickup roller moves from a contact position at which at least the pickup roller is in contact with the uppermost sheet to a separation position at which the pickup roller is separated from the uppermost sheet to a cancel of contact of the pickup roller with the uppermost sheet.

The pickup roller does not immediately separate from the sheet when the separation movement. After the pickup roller moves to the separation position for a certain amount and the elastic layer of the pickup roller that is elastically deformed is restored, the contact of the pickup roller to the sheet is cancelled. In general, regardless of the length of the sheet in the sheet conveyance direction, the separation movement of the pickup roller is started evenly at a given timing at which the leading end of the sheet passes through the conveyance roller pair of the conveyance mechanism, which is disposed downstream from the pickup roller in the sheet conveyance direction and conveys the sheet. As disclosed in the sheet conveying device in the related art, if the moving speed at which the pickup roller moves from the contact position at which the pickup roller is in contact with the uppermost sheet to the separation position at which the pickup roller is separated from the uppermost sheet ("separating speed") is slower than the moving speed at which the pickup roller is moved from the separation position to the contact position ("contact speed"), the time from the start of contact of the pickup roller to the sheet to the cancellation of contact of the pickup roller from the sheet is longer than the separating speed that is equal to the contact speed. For this reason, depending on the distance from the contact position of the pickup roller with the sheet to the trailing end of the sheet at the start of the separation movement, it is likely that the trailing end of the sheet passes through the pickup roller before the contact of the pickup roller with the sheet is cancelled. As a result, it is likely that the subsequent sheet is fed by the pickup roller at a timing that is not the target timing.

By contrast, in Aspect 1, the conveyance of the sheet by the conveyance mechanism is temporarily stopped during a time from the start of at least the separation movement of the pickup roller to the cancellation of contact of the pickup roller with the uppermost sheet. Due to such a configuration, the trailing end of the sheet does not pass through the contact position with the pickup roller before the cancellation of contact of the pickup roller with the sheet. According to the present disclosure, the pickup roller can be moved to the separation position at the separating speed at which the sound of collision is reduced. As a result, while the noise at the conveyance of the sheet is reduced, the subsequent sheet can be prevented from being fed by the pickup roller at a timing other than the target timing.

Aspect 2

In Aspect 2, according to Aspect 1, the separator (for example, the contact-separation mechanism 210) includes a pickup arm (for example, the pickup arm 202), a biasing member (for example, the sheet feed pressure spring 213), a solenoid (for example, the solenoid 206), and a solenoid link (for example, the solenoid link 207). The pickup arm rotatably supports the pickup roller to move the pickup roller between the contact position and the separation position. The biasing member biases the pickup arm to maintain the pickup roller at the contact position. The solenoid link is coupled to the solenoid and rotates along with a linear motion of the solenoid to rotate the pickup roller.

According to this configuration, by controlling the drive of the solenoid 206, the separating speed of the pickup roller can be adjusted.

Aspect 3

In Aspect 3, according to Aspect 1, the sheet conveying device (for example, the sheet conveying device 100) has a first mode such as a high-speed low-noise mode and a second mode such as a high-speed mode. In the first mode, the conveyance of the uppermost sheet by the conveyor is temporarily stopped during the period of time from the start of the separation movement in which the pickup roller moves from the contact position at which at least the pickup roller is in contact with the uppermost sheet to the separation position at which the pickup roller is separated from the uppermost sheet to the cancel of contact of the pickup roller with the uppermost sheet. In the second mode, the conveyance of the uppermost sheet by the conveyor is not temporarily stopped during the period of time from the start of a separation movement in which the pickup roller moves from the contact position at which at least the pickup roller is in contact with the uppermost sheet to the separation position at which the pickup roller is separated from the uppermost sheet to the cancel of contact of the pickup roller with the uppermost sheet.

According to this configuration, as described in the embodiments above, the productivity-oriented users can select the second mode such as a high-speed mode and the quietness-oriented users can select the first mode such as a high-speed low-noise mode. Accordingly, this configuration can satisfy both the quietness-oriented users and the productivity-oriented users.

Aspect 4

In Aspect 4, according to Aspect 3, the separation speed at which the pickup roller separates from the uppermost sheet in the first mode such as the high-speed low-noise mode is slower than a separation speed at which the pickup roller separates from the uppermost sheet in the second mode such as the high-speed mode.

According to this configuration, the sound of collision occurred in the separation movement in the first mode such as the high-speed low-noise mode can be reduced, and the trailing end of the sheet passes through the pickup roller before the cancellation of contact of the pickup roller with the conveyance sheet in the second mode such as the high-speed mode. Accordingly, the subsequent sheet is prevented from being fed by the pickup roller at a timing other than the target timing.

Aspect 5

In Aspect 5, according to Aspect 3, the separation speed at which the pickup roller separates from the uppermost sheet in the first mode such as the high-speed low-noise mode is slower than a separation speed at which the pickup roller separates from the uppermost sheet in the second mode such as the high-speed mode.

According to this operation, as described in the embodiments above, the mode can be selected in accordance with the preference of a user.

Aspect 6

In Aspect 6, according to any one of Aspects 1 to 5, the conveyor (for example, the inner sheet conveyor 170) includes a registration roller pair (for example, the registration roller pair 106) to be contacted by a leading end of the uppermost sheet to temporarily stop the uppermost sheet, and the circuitry (for example, the controller 150) sets an upstream sheet conveying speed of the uppermost sheet to the registration roller pair is faster than a downstream sheet conveying speed of the uppermost sheet from the registration roller pair.

According to this configuration, as described in the embodiments above, the upstream sheet conveying speed to the registration roller pair is faster than the downstream sheet conveying speed from the registration roller pair. By so doing, the delay due to a temporary stop of the conveyance of the sheet in the separation movement of the pickup roller (for example, the pickup roller 201) can be restored before the sheet reaches the registration roller pair. Accordingly, the quietness can be enhanced without decreasing the productivity.

Aspect 7

In Aspect 1, a sheet conveying device (for example, the sheet conveying device 100) includes a pickup roller (for example, a pickup roller 201), a separator (for example, the contact-separation mechanism 210), a conveyor (for example, the inner sheet conveyor 170), and circuitry (for example, the controller 150). The pickup roller contacts an uppermost sheet of sheets stacked on a sheet stacker (for example, the sheet tray 103, the bypass sheet tray 104) and feeds the uppermost sheet. The separator brings the pickup roller to contact or separate from the uppermost sheet. The conveyor conveys the uppermost sheet fed by the pickup roller. The circuitry controls operations performed in the sheet conveying device. The circuitry controls a first sheet conveying speed of the uppermost sheet during a period of time from a start of a separation movement in which the pickup roller moves from a contact position at which at least the pickup roller is in contact with the uppermost sheet to a separation position at which the pickup roller is separated from the uppermost sheet to a cancel of contact of the pickup roller with the uppermost sheet, and a second sheet conveying speed of the uppermost sheet after completion of the separation movement. The circuitry configured to set the first sheet conveying speed slower than the second sheet conveying speed.

According to this configuration, as described in the embodiments above, even if the separating speed of the pickup roller is slower than the separating speed of the typical pickup roller, the trailing end of the sheet is prevented from the contact position with the pickup roller before the contact of the pickup roller with the sheet is cancelled. According to the present disclosure, while the noise is reduced, a subsequent sheet is prevented from being fed out by the pickup roller at a timing other than the target timing.

Aspect 8

In Aspect 8, an image forming apparatus (for example, the image forming apparatus 101) includes the sheet conveying device (for example, the sheet conveying device 100) according to any one of Aspects 1 to 6, and an image forming device (for example, the image forming device 107) to form an image on a sheet supplied by the sheet conveying device.

According to this configuration, the quietness can be enhanced and the sheet feeding failure can be prevented.

Aspect 9

In Aspect 9, an image forming apparatus (for example, the image forming apparatus 101) includes the sheet conveying device (for example, the sheet conveying device 100) according to Aspect 8, and an image forming device (for example, the image forming device 107) to form an image on a sheet supplied by the sheet conveying device.

Aspect 10

In Aspect 10, a sheet conveying device (for example, the sheet conveying device 100) includes a pickup roller (for example, a pickup roller 201), a separator (for example, the contact-separation mechanism 210), a conveyor (for example, the inner sheet conveyor 170), and circuitry (for example, the controller 150). The pickup roller contacts an uppermost sheet of sheets stacked on a sheet stacker (for example, the sheet tray 103, the bypass sheet tray 104) and feeds the uppermost sheet. The separator moves the pickup roller between a contact position at which the pickup roller is in contact with the uppermost sheet and a separation position at which the pickup roller is separated from the uppermost sheet. The conveyor conveys the uppermost sheet fed by the pickup roller. The circuitry is to control the conveyor to temporarily stop conveyance of the uppermost sheet, and control the separator to move the pickup roller from the contact position to the separation position in response to the temporarily stop of the conveyor.

Aspect 11

In Aspect 11, according to Aspect 10, the circuitry (for example, the controller 150) is further to restart the conveyance of the uppermost sheet in response to a separation of the pickup roller (for example, the pickup roller 201) from the uppermost sheet.

Aspect 12

In Aspect 12, the sheet conveying device (for example, the sheet conveying device 100) according to Aspect 10 further includes a sensor downstream of the pickup roller (for example, the pickup roller 201) to detect a leading end of the uppermost sheet. The circuitry (for example, the controller 150) is further to control the conveyor (for example, the inner sheet conveyor 170) to temporarily stop conveyance of the uppermost sheet at a predetermined timing from when the leading end of the uppermost sheet passes through the conveyor to when the leading end of the uppermost sheet is detected by the sensor.

Aspect 13

In Aspect 13, the sheet conveying device (for example, the sheet conveying device 100) according to Aspect 10 further includes a sensor downstream of the pickup roller (for example, the pickup roller 201) to detect a leading end of the uppermost sheet. The circuitry (for example, the controller 150) is further to control the conveyor to temporarily stop conveyance of the uppermost sheet after the uppermost sheet has been conveyed for a predetermined time from a detection of the leading end of the uppermost sheet (for example, the conveyance target sheet 102*a*) by the sensor.

Aspect 14

In Aspect 14, according to Aspect 10, the separator (for example, the contact-separation mechanism 210) includes a pickup arm, a biasing member, a solenoid, and a solenoid link. The pickup arm rotatably supports the pickup roller (for example, the pickup roller 201) to move the pickup roller between the contact position and the separation position. The biasing member biases the pickup arm to bias the pickup roller toward the uppermost sheet. The solenoid drives the pickup arm. The solenoid link is coupled to the solenoid to rotate the pickup arm. The circuitry (for example, the controller 150) controls the solenoid to move the solenoid link to swing the pickup arm and the pickup roller.

Aspect 15

In Aspect 15, according to Aspect 10, the circuitry (for example, the controller 150) is further to control the separator (for example, the contact-separation mechanism 210) to move the pickup roller (for example, the pickup roller 201) from the contact position to the separation position in response to the temporarily stop of the conveyor (for example, the inner sheet conveyor 170) in a first mode, and control the separator to move the pickup roller from the contact position to the separation position without the temporarily stop of the conveyor in a second mode.

Aspect 16

In Aspect 16, according to aspect 15, the circuitry (for example, the controller 150) controls the separator (for example, the contact-separation mechanism 210) to move the pickup roller (for example, the pickup roller 201) from the contact position to the separation position at a first speed in the first mode, and the circuitry controls the separator to move the pickup roller from the contact position to the separation position at a second speed higher than the second speed in the second mode.

Aspect 17

In Aspect 17, according to Aspect 15, the circuitry (for example, the controller 150) is further to display, on an operation display, a selection button by which the first mode or the second mode is selectable.

Aspect 18

In Aspect 18, according to Aspect 10, the conveyor (for example, the inner sheet conveyor 170) includes a registration roller pair at which a leading end of the uppermost sheet contacts to be temporarily stopped. The circuitry (for example, the controller 150) is further to control the pickup roller (for example, the pickup roller 201), the conveyor, and the registration roller to convey the uppermost sheet from the pickup roller to the registration roller pair at a first conveyance speed, and convey the uppermost sheet to downstream of the registration roller pair at a second conveyance speed lower than the first conveyance speed.

Aspect 19

In Aspect 19, an image forming apparatus (for example, the image forming apparatus 101) includes the sheet conveying device (for example, the sheet conveying device 100) according to Aspect 10 to feed a sheet, and an image forming device (for example, the image forming device 107) to form an image on the sheet fed from the sheet conveying device.

Aspect 20

In Aspect 20, a sheet conveying device (for example, the sheet conveying device 100) includes a pickup roller (for example, a pickup roller 201), a separator (for example, the contact-separation mechanism 210), a conveyor (for example, the inner sheet conveyor 170), and circuitry (for example, the controller 150). The pickup roller contacts an uppermost sheet of sheets stacked on a sheet stacker (for example, the sheet tray 103, the bypass sheet tray 104) and feeds the uppermost sheet. The separator moves the pickup roller between a contact position at which the pickup roller is in contact with the uppermost sheet and a separation position at which the pickup roller is separated from the uppermost sheet. The conveyor conveys the uppermost sheet fed by the pickup roller. The circuitry is to control the separator to moves the pickup roller from the contact position to the separation position in a separation operation, control the conveyor to convey the uppermost sheet at a first conveyance speed from a start to a completion of the separating operation, and control the conveyor to convey the uppermost sheet at a second conveyance speed higher than the first conveyance speed after the completion of the separating operation.

Aspect 21

In Aspect 21, an image forming apparatus (for example, the image forming apparatus 101) includes the sheet conveying device (for example, the sheet conveying device 100) according to Aspect 20 to feed a sheet, and an image forming device (for example, the image forming device 107) to form an image on the sheet fed from the sheet conveying device.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet conveying device comprising:

a pickup roller configured to:

contact an uppermost sheet of sheets stacked on a sheet stacker; and feed the uppermost sheet;

a separator configured to move the pickup roller between:

a contact position at which the pickup roller is in contact with the uppermost sheet; and a separation position at which the pickup roller is separated from the uppermost sheet;

a conveyor configured to convey the uppermost sheet fed by the pickup roller; and circuitry configured to:

control the conveyor to temporarily stop conveyance of the uppermost sheet while the uppermost sheet is being conveyed; and control the separator to move the pickup roller from the contact position to the separation position while the conveyance of the uppermost sheet is temporarily stopped.

2. The sheet conveying device according to claim 1, wherein the circuitry is further configured to restart the conveyance of the uppermost sheet in response to a separation of the pickup roller from the uppermost sheet.

3. The sheet conveying device according to claim 1, further comprising a sensor downstream of the pickup roller to detect a leading end of the uppermost sheet, wherein the circuitry is further configured to:

control the conveyor to temporarily stop conveyance of the uppermost sheet at a predetermined timing from when the leading end of the uppermost sheet passes through the conveyor to when the leading end of the uppermost sheet is detected by the sensor.

4. The sheet conveying device according to claim 1, further comprising a sensor downstream of the pickup roller to detect a leading end of the uppermost sheet, wherein the circuitry is further configured to:

control the conveyor to temporarily stop conveyance of the uppermost sheet after the uppermost sheet has been conveyed for a predetermined time from a detection of the leading end of the uppermost sheet by the sensor.

5. The sheet conveying device according to claim 1, wherein the separator includes:

a pickup arm rotatably supporting the pickup roller to move the pickup roller between the contact position and the separation position;

a biasing member configured to bias the pickup arm to bias the pickup roller toward the uppermost sheet;

a solenoid to drive the pickup arm; and a solenoid link coupled to the solenoid to rotate the pickup arm, and wherein the circuitry configured to control the solenoid to move the solenoid link to swing the pickup arm and the pickup roller.

6. The sheet conveying device according to claim 1, wherein the circuitry is further configured to:

control the separator to move the pickup roller from the contact position to the separation position in response to the temporary stop of the conveyor in a first mode; and control the separator to move the pickup roller from the contact position to the separation position without the temporarily stop of the conveyor in a second mode.

7. The sheet conveying device according to claim 6, wherein the circuitry controls the separator to move the pickup roller from the contact position to the separation position at a first speed in the first mode, and wherein the circuitry controls the separator to move the pickup roller from the contact position to the separation position at a second speed higher than the second speed in the second mode.

8. The sheet conveying device according to claim 6, wherein the circuitry is further configured to display, on an operation display, a selection button by which the first mode or the second mode is selectable.

9. The sheet conveying device according to claim 1, wherein:

the conveyor includes a registration roller pair at which a leading end of the uppermost sheet contacts to be temporarily stopped, and the circuitry is further configured to control the pickup roller, the conveyor, and the registration roller to:

convey the uppermost sheet from the pickup roller to the registration roller pair at a first conveyance speed; and convey the uppermost sheet to downstream of the registration roller pair at a second conveyance speed lower than the first conveyance speed.

10. An image forming apparatus comprising:

the sheet conveying device according to claim 1 to feed a sheet; and an image forming device configured to form an image on the sheet fed from the sheet conveying device.

11. A sheet conveying device comprising:

a pickup roller configured to:

contact an uppermost sheet of sheets stacked on a sheet stacker; and feed the uppermost sheet;

a separator configured to move the pickup roller between:

a contact position at which the pickup roller is in contact with the uppermost sheet; and a separation position at which the pickup roller is separated from the uppermost sheet;

a conveyor configured to convey the uppermost sheet fed by the pickup roller; and circuitry configured to:

control the separator to moves the pickup roller from the contact position to the separation position in a separation operation;

control the conveyor to convey the uppermost sheet at a first conveyance speed from a start to a completion of the separating operation; and control the conveyor to convey the uppermost sheet at a second conveyance speed higher than the first conveyance speed after the completion of the separating operation.

12. An image forming apparatus comprising:

the sheet conveying device according to claim 11 to feed a sheet; and an image forming device configured to form an image on the sheet fed from the sheet conveying device.

13. A sheet conveying device comprising:

a pickup roller configured to:

contact an uppermost sheet of sheets stacked on a sheet stacker; and feed the uppermost sheet;

a separator configured to move the pickup roller between:

a contact position at which the pickup roller is in contact with the uppermost sheet; and a separation position at which the pickup roller is separated from the uppermost sheet;

a conveyor configured to convey the uppermost sheet fed by the pickup roller; and circuitry configured to:

control the conveyor to temporarily stop conveyance of the uppermost sheet;

control the separator to move the pickup roller from the contact position to the separation position in response to the temporary stop of the conveyor; and restart the conveyance of the uppermost sheet in response to a separation of the pickup roller from the uppermost sheet.

* * * * *